US010543418B1

(12) United States Patent
Scicchitano et al.

(10) Patent No.: US 10,543,418 B1
(45) Date of Patent: Jan. 28, 2020

(54) CLIMBING SKIN ATTACHMENT APPARATUS, METHODS, AND SYSTEMS

(71) Applicant: G3 Genuine Guide Gear Inc., Burnaby, BC (CA)

(72) Inventors: Bart Scicchitano, Vancouver (CA); Cameron Shute, Nelson (CA); Robbie Gordon Roberts, Port Moody (CA); Edward McCarthy, North Vancouver (CA)

(73) Assignee: G3 Genuine Guide Gear Inc., Burnaby, BC (CA)

( * ) Notice: Subject to any disclaimer, the term of this patent is extended or adjusted under 35 U.S.C. 154(b) by 0 days.

(21) Appl. No.: 16/172,625

(22) Filed: Oct. 26, 2018

(51) Int. Cl.
*A63C 7/04* (2006.01)

(52) U.S. Cl.
CPC ..... *A63C 7/04* (2013.01)

(58) Field of Classification Search
CPC ..... A63C 7/00; A63C 7/02; A63C 7/04
See application file for complete search history.

(56) References Cited

U.S. PATENT DOCUMENTS

| | | | |
|---|---|---|---|
| 6,471,234 | B2 | 10/2002 | Ayliffe |
| 6,604,755 | B2 | 8/2003 | Ayliffe et al. |
| 7,287,775 | B2 | 10/2007 | Walker et al. |
| 8,474,853 | B2 | 7/2013 | Rogers et al. |
| 8,844,963 | B2 | 9/2014 | McCrank et al. |
| 9,908,030 | B2 | 3/2018 | Shute et al. |
| 2006/0267332 | A1 | 11/2006 | Fischli |
| 2017/0120136 | A1* | 5/2017 | Shute ..... A63C 7/02 |

FOREIGN PATENT DOCUMENTS

| | | | |
|---|---|---|---|
| AT | 14058 | U1 | 3/2015 |
| CA | 2332217 | C | 4/2002 |
| DE | 102012201230 | A1 | 8/2013 |
| EP | 1533007 | A1 | 5/2005 |
| EP | 1731201 | A1 | 12/2006 |
| EP | 1882501 | A2 | 1/2008 |

OTHER PUBLICATIONS

European Patent Office, "Extended European Search Report" in connection with related European Patent Application No. 18204680.5, dated Jun. 21, 2019, 9 pgs.

Romeo, Steve (randosteve), "Installing New Black Diamond Adjustable Skin-Tip Loops", Tetonat.com, http://www.tetonat.com/2009/08/17/installing-new-black-diamond-adjustable-skin-tip-loops/ (Published: Aug. 17, 2009) (Accessed: Jan. 24, 2019).

* cited by examiner

*Primary Examiner* — John D Walters
*Assistant Examiner* — James J Triggs
(74) *Attorney, Agent, or Firm* — Kolisch Hartwell, P.C.

(57) ABSTRACT

One aspect of this disclosure is a climbing skin attachment apparatus. The apparatus may comprise a climbing skin attachment portion and a snow device connection portion, a channel extending at least partially through the climbing skin attachment portion along a channel axis to receive an anchor portion of a climbing skin, and a passage extending through the climbing skin attachment portion and into the channel along the channel axis to receive a lead portion of the climbing skin. Related apparatus, methods, and systems also are described.

20 Claims, 16 Drawing Sheets

CLIMBING SKIN ATTACHMENT APPARATUS, METHODS, AND SYSTEMS

BACKGROUND

Field

This disclosure relates to exemplary climbing skin attachment apparatus, methods, and systems.

Description of Related Art

Climbing skins are used to assist in ascending a slope. A climbing skin may comprise a strip of material that is attached to an under surface of a snow device (e.g., a ski, snowboard, or snowboard half). Original climbing skins were made from the skins of animals. More recent climbing skins may be been made from synthetic fabrics comprising a nap of stiff, rearward angled fibers projecting from a bottom surface. With these types of skins attached, the snow device may be slid in a forward direction with relative ease and yet prevent rearward movements, allowing the user to ascend slopes by sliding one skin forward and then the other.

Various means for attaching a climbing skin to a snow device are known. A common method for affixing the skin to the undersurface of the snow device involves the use of glue adhered to the climbing skin on a surface opposite to that of the nap. For example, the glue may be adapted to remain sticky at low temperatures and permit repeated attachment and removal of the skin from the undersurface. To support the glue, a front end of the climbing skin may be attached to a front end of the snow device by a front clip, and a rear end of the climbing skin may be attached to a rear end of the snow device by a rear clip.

Known means for attaching the front and rear clips to the climbing skin may include adhesives, riveting, and/or stitching. Because they comprise permanent attachments, it may be difficult to remove these clips from the climbing skin without specialized tools, making field repairs difficult or impossible. Some examples are disclosed in U.S. Pat. No. 8,474,853, including snap-fits (e.g., FIG. 6A-B); rivets (e.g., FIG. 9); and thermal bonding, mechanical fastening, or chemical bonding (e.g., FIG. 13). Additional adhesive examples are disclosed in U.S. Pat. No. 7,287,775 (e.g., FIG. 5). Further improvements are required to solve these known problems and overcome other deficiencies in the art.

SUMMARY

One aspect of this disclosure is a climbing skin attachment apparatus. For example, the apparatus may comprise: a climbing skin attachment portion and a snow device connection portion; a channel extending at least partially through the climbing skin attachment portion along a channel axis to receive an anchor portion of a climbing skin; and a passage extending through the climbing skin attachment portion and into the channel along the channel axis to receive a lead portion of the skin.

The climbing skin attachment portion may be disposed opposite of the snow device connection portion along a longitudinal axis; and the channel axis may be non-parallel with the longitudinal axis. The passage may be configured to obtain an interference fit with the anchor portion. The snow device connection portion may comprise at least one of an open shape and a closed shape engageable with the end of the snow device. The passage may extend into the channel along a passage axis that is non-parallel with the channel axis. The passage may be engageable with the anchor portion to resist a longitudinal movement of the skin; and the climbing skin attachment portion may comprise at least one of a metallic material and a polymeric material configured to resist deformation of the passage during the longitudinal movement.

The channel may extend along the channel axis between a first sidewall of the climbing skin attachment portion and second sidewall of the climbing skin attachment portion; and at least one of the first sidewall and the second sidewall may comprise a flexural reinforcing element. For example, the flexural reinforcing element may comprise at least one of: an end wall attached to the first and second sidewalls; and a ribbing element of the first and second sidewalls.

An interior surface of the channel may be configured to grip the climbing skin. For example, the interior surface of the channel may comprise at least one of a barb, a hook, and a protrusion. The apparatus may comprise a skewer engageable with the anchor portion in the channel to prevent the anchor portion from being pulled out of the passage. For example, an exterior surface of the skewer may be configured to grip the climbing skin; and the exterior surface of the skewer may comprise at least one of a barb, a hook, and a protrusion.

Another aspect of the present disclosure is a climbing skin attachment method. For example, the method may comprise: receiving an anchor portion of a climbing skin in a channel extending at least partially through a climbing skin attachment apparatus along a channel axis, and a lead portion of the climbing skin in a passage extending through the climbing skin attachment apparatus and into the channel along the channel axis; and engaging the climbing skin attachment apparatus with a snow device.

The method may comprise engaging a skewer with the anchor portion in the channel to prevent the anchor portion from being pulled through the passage. For example, the method may comprise securing the skewer to the climbing skin attachment apparatus.

Yet another aspect of the present disclosure is a climbing skin attachment system comprising: (A) one or more climbing skin attachment apparatus comprising: a climbing skin attachment portion and a snow device connection portion; a channel extending at least partially through the climbing skin attachment portion along a channel axis; and a passage extending through the climbing skin attachment portion and into the channel along the channel axis; and (B) a climbing skin comprising: at least one anchor portion receivable in the channel of at least one of the one or more climbing skin attachment apparatus along the channel axis; and at least one lead portion receivable in the passage of the at least one climbing skin attachment apparatus along the channel axis.

The climbing skin may comprise a first end comprising a first anchor portion and a first lead portion and a second end comprising a second anchor portion and a second lead portion; and the one or more climbing skin attachment apparatus may comprise: a first apparatus comprising a first channel and a first passage configured to receive the corresponding first anchor portion and first lead portion of the first end of the climbing skin; and a second apparatus comprising a second channel and a first passage configured to receive the corresponding second anchor portion and second lead portion of the second end of the climbing skin.

The one or more climbing skin attachment apparatus may comprise a rear clip apparatus. For example, the rear tail clip apparatus may comprise: a tension strap extending between the climbing skin attachment portion and the snow device connection portion; a first connection arm extending along an arm axis between a fixed clip and a strap opening engageable with the tension strap; and a second connection arm comprising: a pivot engageable with the first connection arm; and a cam surface engageable with an edge of a snow device when the second connection arm is pivoted about the first connection arm with the pivot. In this example, the fixed clip may be engageable with a straight edge of the snow device and the cam surface may be engageable with a curved edge of the snow device along a camming axis that intersects the arm axis.

Additional methods, kits, and systems may be described with reference to the aspects described herein and/or inherent to those descriptions.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are particularly described, pointed out, and taught in the written descriptions. Some structural and operation aspects may be even better understood by referencing the written portions together with the accompanying drawings, of which.

DETAILED DESCRIPTION

Aspects of the present disclosure are not limited to the exemplary structural details and component arrangements described in the written descriptions and shown in the accompanying drawings. Many aspects of this disclosure may be applicable to other aspects and/or capable of being practiced or carried out in various variants of use, including those described herein.

Throughout the written descriptions, specific details are set forth in order to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Aspects of this disclosure reference exemplary climbing skin attachment apparatus, methods, and systems. Some aspects are described with reference to particular attachment means (e.g., clips) operable with particular types of snow devices (e.g., skis or halves of a split snowboard). Unless claimed, these exemplary aspects are provided for convenience and not intended to limit the present disclosure. Accordingly, the concepts described in this disclosure may be utilized for any attachment means and with any type of snow device.

Figure 2:
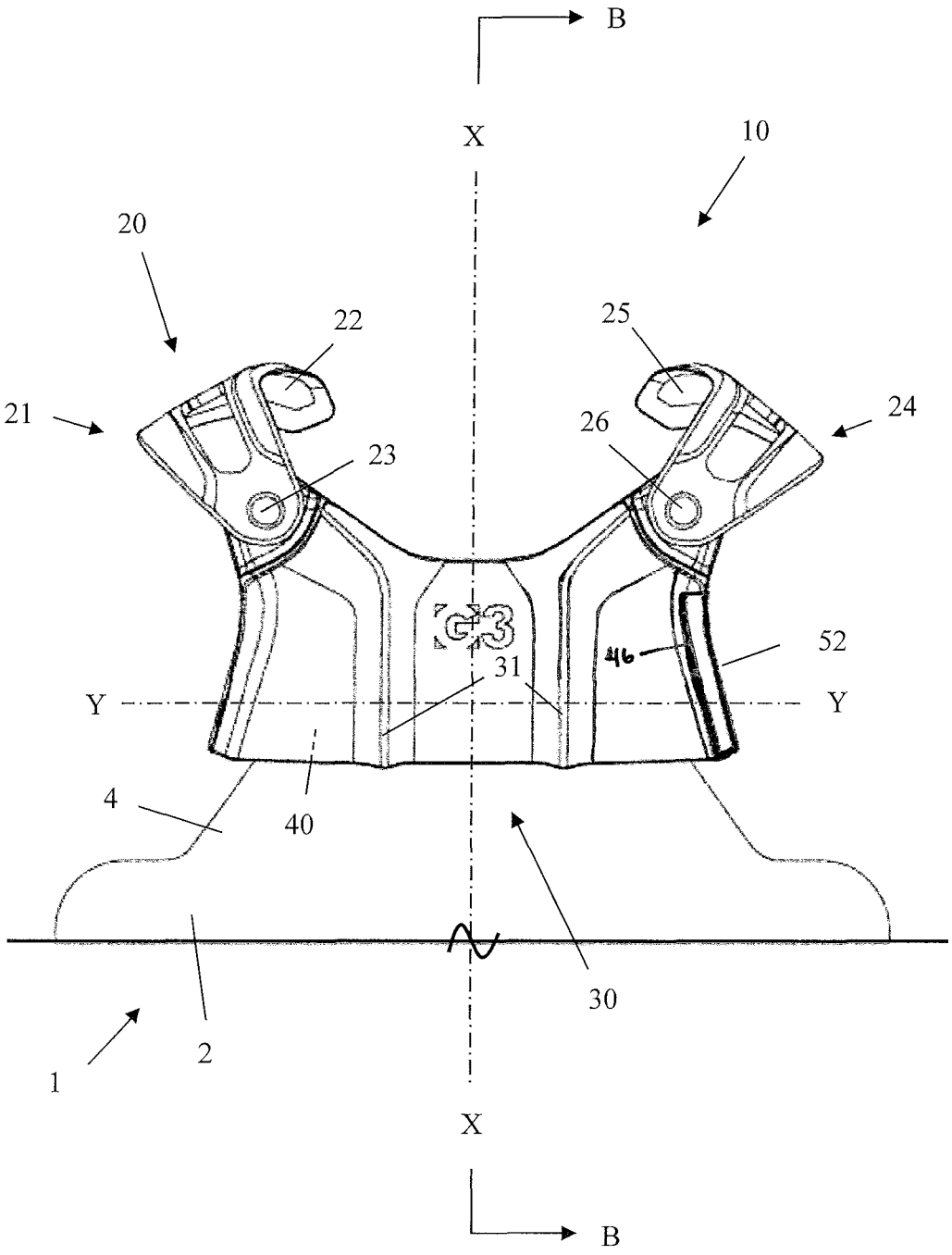
FIG. 2 depicts a close-up snow facing view of the apparatus of FIG. 1 at area A, and indicates a section line B-B.

The present disclosure references two main axes, including: a longitudinal X-X axis and a lateral Y-Y axis. Elements may be described with reference to these main axes. As shown in FIG. 2, longitudinal axis X-X and lateral axis Y-Y may define relative arrangements of one element to another. For example, axis X-X may be non-parallel with axis Y-Y in some perspectives, meaning that axis X-X may extend across and/or intersect axis Y-Y. Additional axes, movements, and forces may be described with reference to axes X-X and Y-Y. These terms are provided for convenience and do not limit this disclosure unless claimed.

As used herein, inclusive terms such as "comprises," "comprising," "includes," "including," and variations thereof, are intended to cover a non-exclusive inclusion, such that an apparatus, method, system, or element thereof comprising a list of elements does not include only those elements, but may include other elements not expressly listed and/or inherent thereto. Unless stated otherwise, the term "exemplary" is used in the sense of "example," rather than "ideal." Various terms of approximation may be used in this disclosure, including "approximately" and "generally." Approximately means within 10% of a stated number or outcome.

Figure 1:
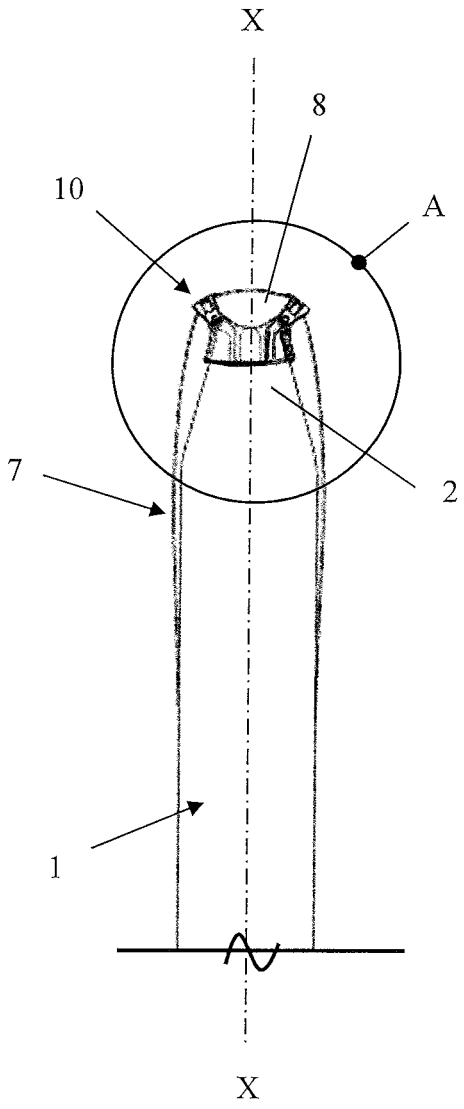
FIG. 1 depicts a snow facing view of an exemplary climbing skin attachment apparatus attached to an exemplary climbing skin and an exemplary snow device, and indicates an area A.

Aspects are now described with reference to FIG. 1, which shows an exemplary climbing skin attachment apparatus 10 configured to attach an end 2 of a climbing skin 1 to an end 8 of a snow device 7, a ski in this example. As shown in FIG. 2, climbing skin attachment apparatus 10 may comprise: a climbing skin connection portion 20; and a snow device attachment portion 30, each of which may be configured to removably attach end 2 of climbing skin 1 to end 8 of snow device 7 (e.g., FIG. 1), and limit movements of skin 1 relative to device 7. End 2 may comprise a front end of snow device 7, as in FIGS. 1 and 2; or a rear end of snow device 7, as described further below with reference to FIGS. 11 and 13.

As shown in FIG. 2, climbing skin connection portion 20 may be disposed opposite of snow device attachment portion 30. For example, as shown, connection portion 20 may be disposed opposite of connection portion 30 along a longitudinal axis X-X of apparatus 10. Any equivalent arrangements may be used.

Connection portion 20 may comprise any combination of open and/or closed shape(s) engageable with any configuration of end 8 of snow device 7. For example, end 8 may be a front end of snow device 7 with an upward tilting curvature, and connection portion 20 may comprise a closed shape (e.g., a rectangular loop) engageable with the upward tilting curvature. As shown in FIG. 2, connection portion 20 also may comprise one or more snow device holders, such as a first snow device holder 21 and a second snow device holder 24; and each holder 21 and 24 may be engageable with end 8.

Climbing skin connection portion 20 and snow device attachment portion 30 also may be coaxial with one another. For example, holders 21 and 24 of FIG. 2 may likewise be coaxial with attachment portion 30 to accommodate different geometrical configurations of end 8 of snow device 7.

One or both of snow device holders 21 and 24 may be engageable with curved and/or straight edges of end 8. For example, one or both of holders 21 and 24 may be pivotally attached to connection portion 20 so that interior surfaces of holders 21 and/or 24 may be adjusted to accommodate the curved and/or straight edges. As shown in FIG. 2, first holder 21 may comprise a first clip 22 attached to a first pivot 23 of connection portion 20; and second holder 24 may comprise a second clip 25 attached to a second pivot 26 of connection portion 20. This configuration may allow one or both of clips 22 and 25 to engage curved edges of front end 8, as shown in FIG. 1; alternatively, one of clips 22 and 25 may be non-pivotally attached to portion 20 and configured to engage a flat edge of end 8 (e.g., as in FIG. 12).

Connection portion 20 and attachment portion 30 may be made of the same or a different material. For example, both of connection portion 20 and attachment portion 30 may be formed, molded, or printed from a polymeric material and/or metallic material. Connection portion 20 may be more flexible than attachment portion 30. For example, connection portion 20 may flex to accommodate lateral movements of snow device 7 during use; and attachment portion 30 may be reinforced for added flexural strength. As shown in FIG. 2, attachment portion 30 may comprise a flexural reinforcing element, such as one or more ribs 31 and/or a metallic material configured to provide the additional flexural strength.

Figure 3:
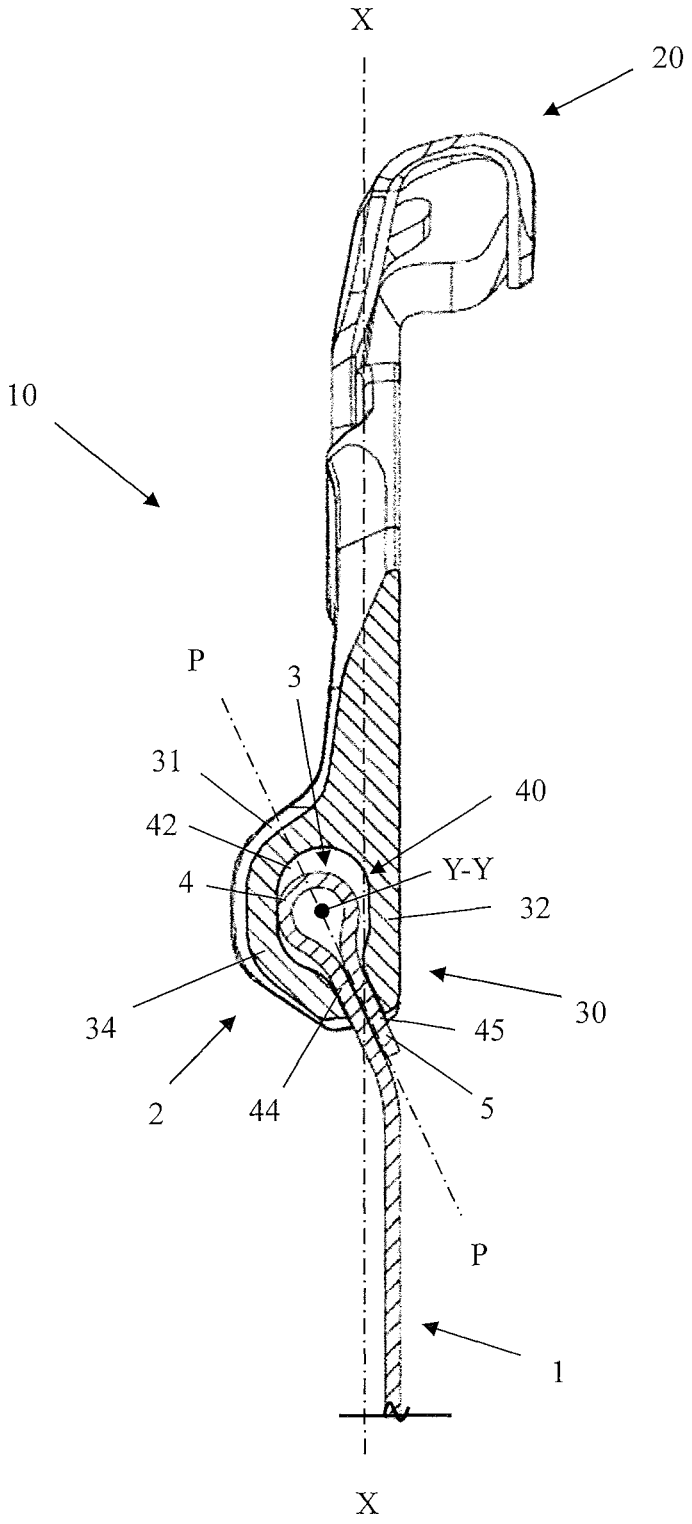
FIG. 3 depicts a cross-section the apparatus of FIG. 1 taken along section line B-B.

As shown in FIGS. 2 and 3, a channel 40 may extend at least partially through attachment portion 30 of climbing skin attachment apparatus 10 along a channel or lateral axis Y-Y that is non-parallel with longitudinal axis X-X. Channel 40 may comprise any open shape(s). As shown in FIG. 3, a passage 44 may extend through attachment portion 30 and into channel 40 along axis Y-Y. In combination, attachment portion 30, channel 40, and passage 44 may be configured to removably attach end 2 of skin 1 to attachment portion 30.

As shown in FIG. 3, apparatus 10 may comprise an entry opening 46 extending into channel 40 and passage 44 along channel axis Y-Y. As also shown, opening 46 may be configured to receive a door 52. For example, opening 46 may comprise irregular shapes and/or edge features engageable with corresponding shapes and/or edge features of door 52 so as to removably attach door 52 to attachment portion 30. The interaction may obtain a snap-fit between door 52 and attachment portion 30, and the snap-fit may resist movements of anchor 3 along axis Y-Y. Door 52 may be attached to portion 30 by one or more hinges. Apparatus 10 may comprise any additional locking mechanisms for door 52.

As shown in FIG. 3, channel 40 and passage 44 may extend along channel axis Y-Y to receive an anchor portion 3 and a lead portion 5 at end 2 of climbing skin 1. Anchor portion 3 may comprise any open and/or closed shape(s) that are receivable in channel 40 and engageable with passage 44 to limit movements of climbing skin 1, including the closed circular shape shown in FIG. 3. For example, anchor portion 3 may comprise: a thickened length of climbing skin 1, such as a fiber weave or matrix different from the remainder of skin 1. As a further example, anchor portion 3 also may comprise a length of climbing skin 1 that has been rolled and/or folded back onto itself and/or attached to another length of skin 1 (e.g., by an adhesive or like attachment elements) to define an anchor shape 4.

Any length of climbing skin 1 extending away from anchor portion 3 may comprise a lead portion 5 of climbing skin 1. Anchor shape 4 and/or the material composition of climbing skin 1 may prevent anchor portion 3 from being pulled through passage 44 in response to a longitudinal force; and lead portion 5 may define a zone for transferring the longitudinal force to the remainder of skin 1. Lead portion 5 also may provide additional force resistance. For example, the fiber composition and/or attachment elements used to form anchor shape 4 also may define lead portion 5 and provide it with an expanded cross-section, making lead portion 5 potentially more durable than the remainder of climbing skin 1, and thus better suited for interacting with climbing skin attachment portion 30 during use.

Channel 40 may receive anchor portion 3 along channel axis Y-Y, and passage 44 may simultaneously receive lead portion 5 along axis Y-Y. The non-parallel arrangement between longitudinal axis X-X and channel axis Y-Y may affect the transfer of forces between climbing skin 1 and attachment portion 30. For example, channel axis Y-Y may be perpendicular or generally perpendicular to longitudinal axis X-X so that longitudinal components of forces applied to climbing skin 1 during use may be evenly transferred from anchor portion 3 to attachment portion 30 along channel axis Y-Y. As a further example, channel axis Y-Y also may be angled or curved relative to longitudinal axis X-X so that lateral components of the applied forces may maintain anchor portion 3 within channel 40 and/or passage 44.

As shown in FIG. 3, passage 44 may extend into channel 40 along a passage axis P-P that is non-parallel with channel axis Y-Y. For example, end 8 of snow device 7 may curve away from a central portion of device 7, and a non-parallel angle between passage axis P-P and channel axis Y-Y may be provided to accommodate the curvature. Moreover, the non-parallel angle also may orient lead portion 5 toward snow device 7 so that rearward forces applied to climbing skin 1 by forward movements of device 7 may be resisted by passage 44; and forward forces applied to skin 1 by rearward movements of device 7 may be resisted by channel 40.

Passage 44 may be engageable with anchor portion 3 to limit a longitudinal movement of climbing skin 1. In complement, attachment portion 30 may be configured to limit deformation of passage 44 relative to axis X-X during the longitudinal movement. Various aspects of attachment portion 30 may be configured to limit the deformation. For example, attachment portion 30 may comprise a metallic material and/or a polymeric material rigid enough to limit the deformation. Channel 40 and passage 44 may extend between a first sidewall 32 of attachment portion 30 and a second sidewall 34 of attachment portion 30. Each sidewall 32 and 34 may comprise a cantilevered beam-element extending outwardly from attachment portion 30 along axis X-X. For example, each beam-element may include cross-section that resists flexural deformation relative to axis X-X when anchor portion 3 engages passage 44. Anchor portion 3 may be wedged into passage 44 so as to apply expansion forces to walls 32 and 34, and the respective cross-sections of sidewalls 32 and 34 may resist the expansion forces.

Figure 4:
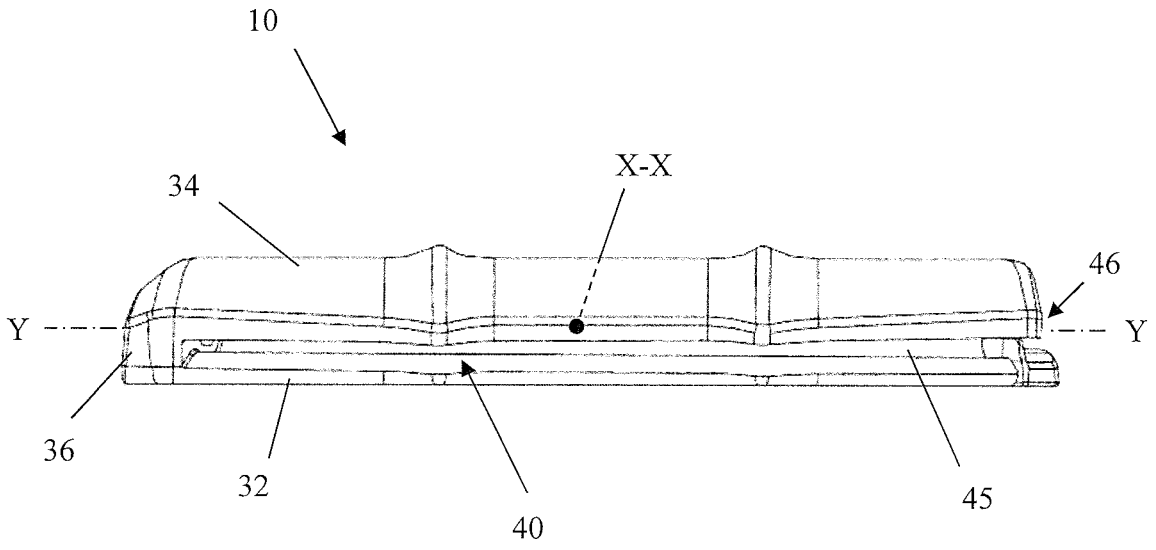
FIG. 4 depicts a view looking into a passage of the apparatus of FIG. 1 taken along a longitudinal axis X-X of the apparatus.

At least one of first sidewall 32 and second sidewall 34 may comprise a flexural reinforcing element that is integral with and/or attached thereto. As shown in FIGS. 3 and 4, the cross-section of sidewalls 32 and/or 34 may be curved relative to longitudinal axis X-X, and the curvature may further resist the expansion forces, as shown in FIG. 3. Ribs 31 may modify the cross-section of sidewalls 32 and/or 34 to further enhance their flexural strength. Attachment portion 30 may be made of a polymeric material comprising a metallic reinforcing element configured to enhance the flexural strength of sidewalls 32 and/or 34. As shown in FIG. 4, first sidewall 32 may be joined to second sidewall 34 by an end wall 36 that further stabilizes walls 32 and 34 by increasing the rigidity of apparatus 10.

The snap-fit between door 52 and attachment portion 30 also may serve as a flexural reinforcing element that increases the rigidity of portion 30. For example, one end of the first and second sidewalls 32 and 34 may be joined by end wall 36 of FIG. 4; and door 52 (shown in FIG. 2), when snapped into entry opening 46, may provide another end wall joining the other end of sidewalls 32 and 34 to further reinforce channel 40 and passage 44 by increasing the rigidity of attachment portion 30. As shown in FIG. 4, a width of lead portion 5 may be approximate to a width between end wall 36 and door 52 (when attached), which may help align the longitudinal axis of climbing skin 1 with longitudinal axis X-X.

In keeping with above, any type of anchor portion 3 comprising any anchor shape 4 may be received in channel 40 along channel axis Y-Y. For example, anchor portion 3 may comprise any folded, rolled, and/or otherwise thickened portions of climbing skin 1, as well as any additional anchoring elements attached thereto, such as a rod, a stopper, or like elements. Desirably, if anchor portion 3 is sufficiently incompressible (e.g., has a minimum compressible width larger than the width of passage 44) and attachment portion 30 is sufficiently rigid (e.g., is made of metal), then no additional anchoring elements may be required to develop a maximum tensile capacity of climbing skin 1.

Additional aspects are now described with reference to FIG. 5, which shows another exemplary climbing skin attachment apparatus 110 for attaching end 2 of climbing skin 1 to end 8 of snow device 7 (e.g., FIG. 1). Attachment apparatus 110 of FIG. 5 may comprise any counterpart elements of apparatus 10 described above, but within the 100 series of numbers, whether or not those elements are shown or expressly described. For example, apparatus 110 may similarly comprise: a climbing skin connection portion 120; and a snow device attachment portion 130, each of which may be likewise configured to removably attach end 2 of climbing skin 1 to end 8 of snow device 7 (e.g., FIG. 1), and limit movements of skin 1 relative to device 7. In contrast to above, climbing skin attachment apparatus 110 may further comprise a skewer 150 operable with anchor portion 3 to limit movements of climbing skin 1 relative to snow device 7.

Figure 5:
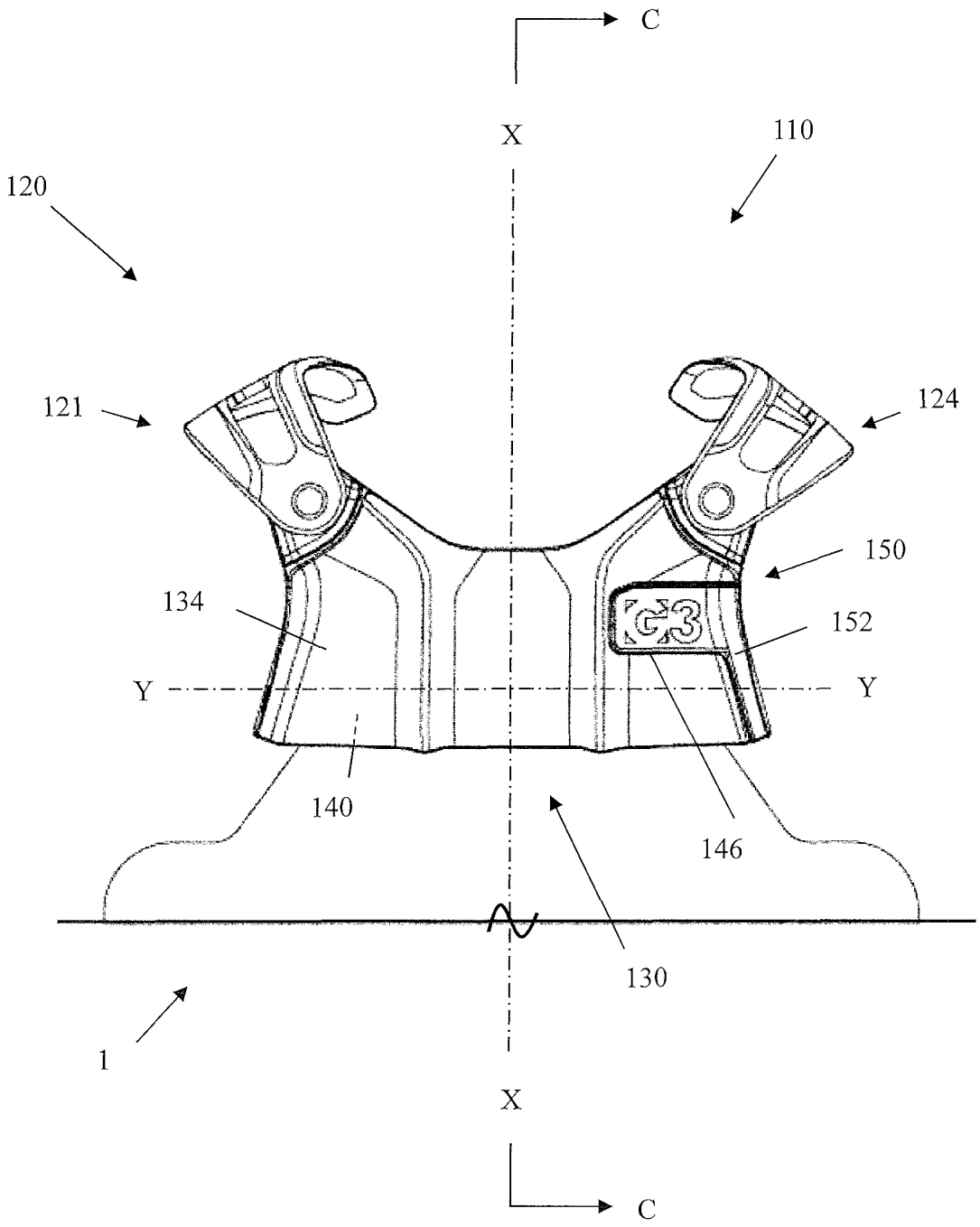
FIG. 5 depicts a snow facing view of another exemplary climbing skin attachment apparatus similar to apparatus of FIG. 1, and indicates a section line C-C.

Connection portion 120 of FIG. 5 may be disposed opposite of or coaxial with attachment portion 130; and/or engageable with any configuration of end 8 of device 7. As before, connection portion 120 may comprise any open and/or closed shape(s) sized to receive end 8 of snow device 7, such a first snow device holder 121 and a second snow device holder 124 that are similar to holders 21 and 24 described above. Attachment portion 120 and connection portion 130 also may be comprised of the same or a different material. For example, portions 120 and 130 may be similarly formed, molded, or printed from a polymeric material and/or a metallic material; and/or reinforced in any manner described herein. As a further example, the additional rigidity provided by the interaction of skewer 150 with climbing skin 10 and attachment portion 130 may allow the entirety of apparatus 110 to be made from flexible polymeric material.

Figure 6:
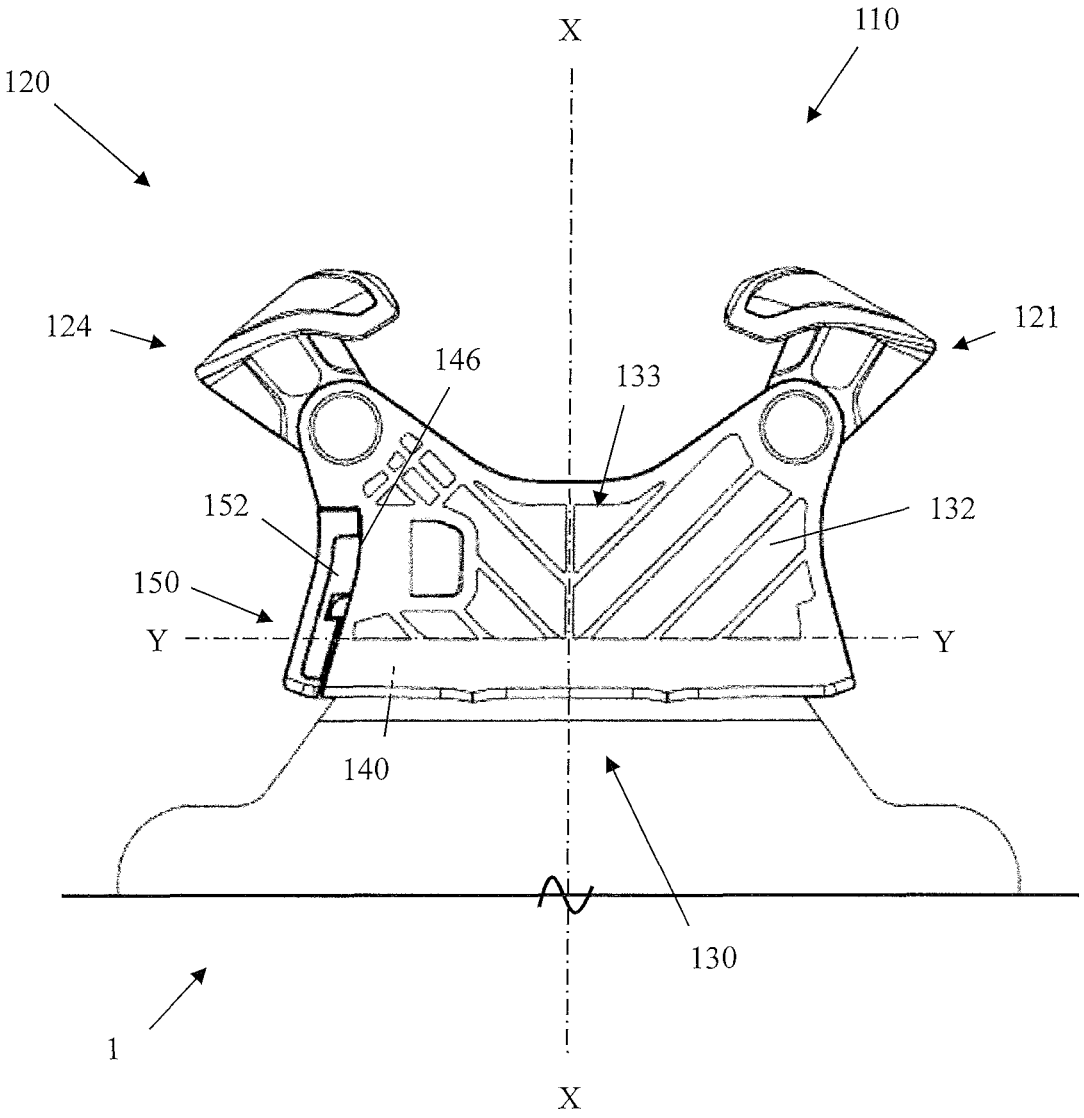
FIG. 6 depicts a device facing view of the apparatus of FIG. 5.
Figure 7:
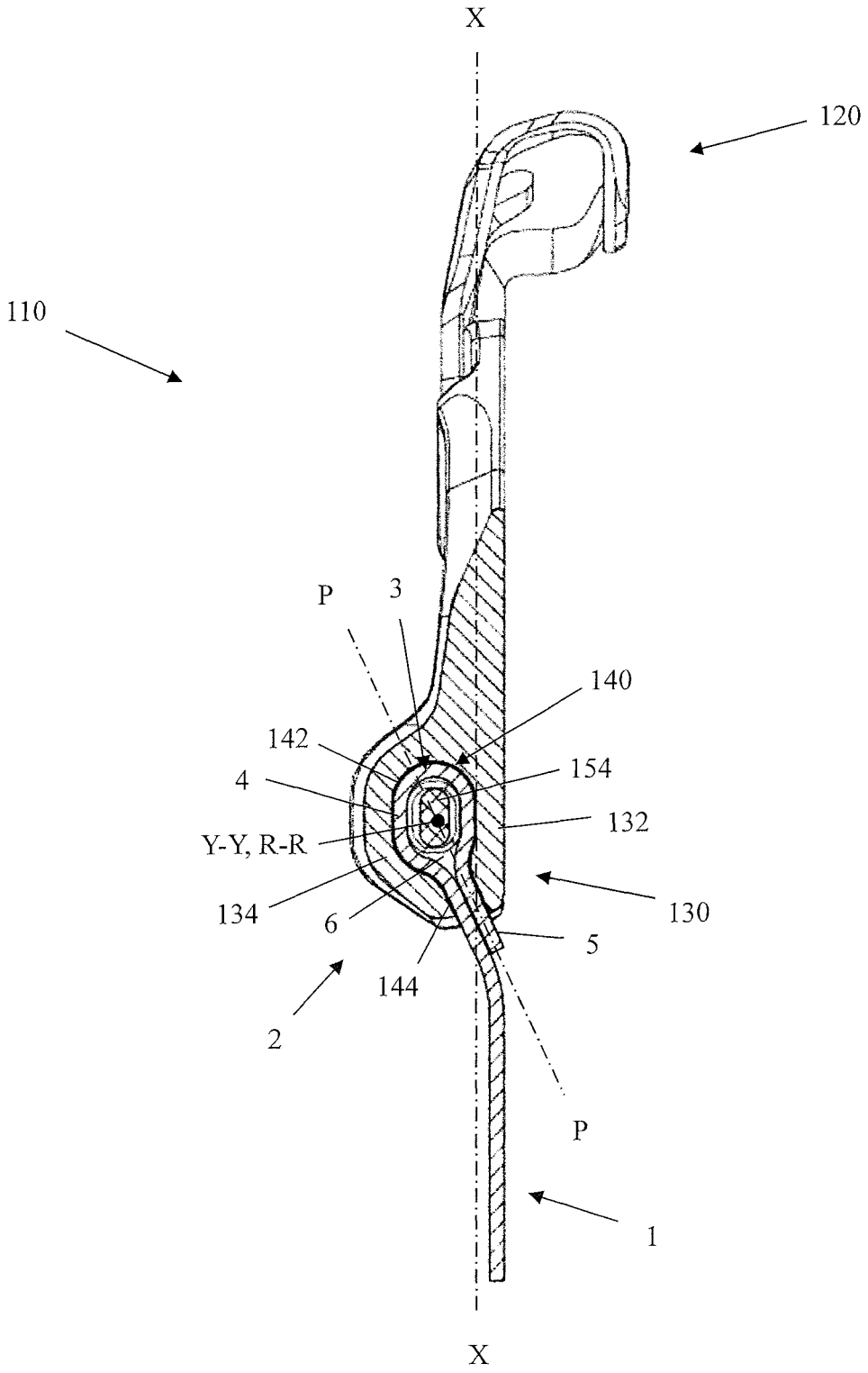
FIG. 7 depicts a cross-section of the apparatus of FIG. 1 taken along section line C-C.

As shown in FIGS. 5, 6, and 7, a channel 140 may extend at least partially through attachment portion 130 along a channel or lateral axis Y-Y; and axis Y-Y may be non-parallel with a longitudinal axis X-X of apparatus 110. Like channel 40, channel 140 also may comprise any shape(s). As shown in FIG. 7, a passage 144 may extend through attachment portion 130 and into channel 140 along channel axis Y-Y. Similar to above, the combination of attachment portion 130, channel 140, and passage 144 may be configured to removably attach end 2 of climbing skin 1 to attachment portion 130. For example, attachment portion 130, channel 140, and passage 144 of apparatus 110 may be configured similarly to any combination of attachment portion 30, channel 40, and passage 44 of apparatus 10. As also shown in FIG. 6, a snow device facing surface of apparatus 110 (or apparatus 10) may comprise surface features 133 engageable with an undersurface of snow device 7.

Figure 9:
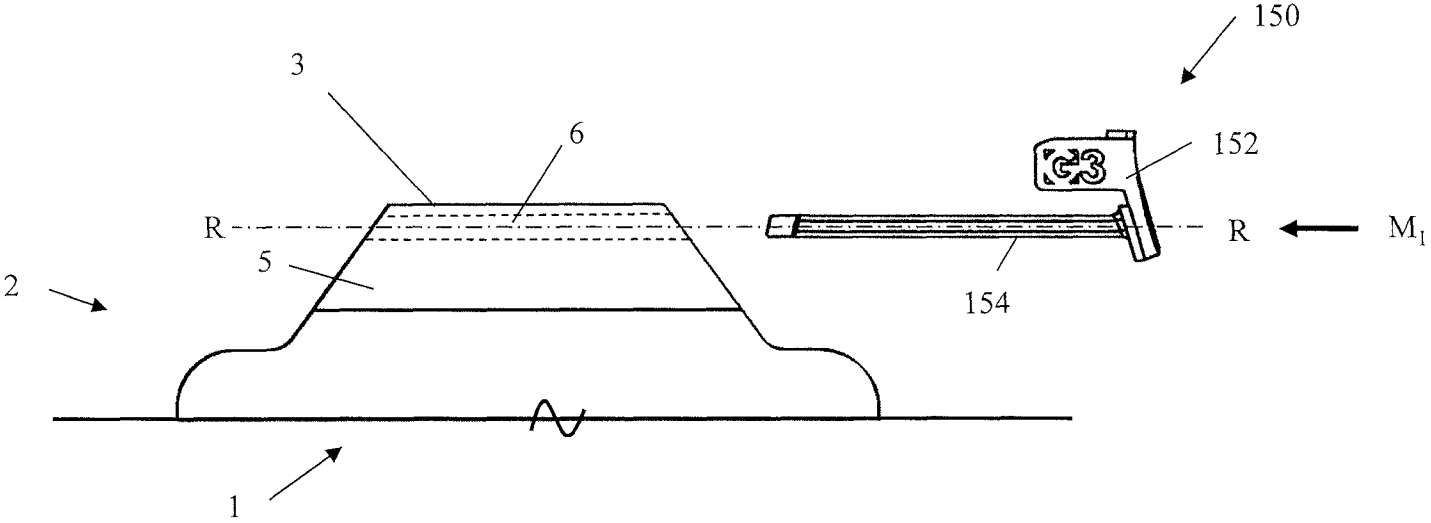
FIG. 9 depicts an exemplary first operational view of the apparatus of FIG. 5.

An exemplary skewer 150 is shown in FIG. 9 as comprising an end portion 152, and a rod 154. As shown in FIG. 5, apparatus 110 may comprise an entry opening 146 extending into channel 140 and passage 144 along channel axis Y-Y. Opening 146 may be configured to receive skewer 150, and be engageable with end portion 152 of skewer 150. For example, opening 146 may comprise an irregular shape and/or edge features engageable with corresponding shapes and/or features of end portion 152 to removably attach skewer 150 to attachment portion 130. For example, entry opening 146 may extend into first sidewall 132 (e.g., FIG. 5) and/or second sidewall 134 (e.g., FIG. 6) of attachment portion 130 to provide contact surfaces engageable with corresponding contact surfaces of end portion 152. The contact surfaces may interact to obtain a snap-fit between skewer 150 and attachment portion 130 that resists movements of rod 154 relative to channel 140.

In keeping with above, the snap-fit may serve as a flexural reinforcing element that increases rigidity of attachment portion 130. For example, one end of the first and second sidewalls 132 and 134 may be joined by an end wall similar to end wall 36 of FIG. 4; and end portion 152, when snapped into entry opening 146, may provide another end wall joining the other end of sidewalls 132 and 134 to further reinforce channel 140 by increasing the rigidity of attachment portion 130.

As shown in FIGS. 7 and 9, rod 154 may be receivable in channel 140 with anchor portion 3 to limit movements of climbing skin 1. For example, anchor portion 3 may define an anchor channel 6, and rod 154 may be received inside of anchor channel 6 within channel 130. The interaction between entry opening 146 and end portion 152 may maintain an alignment between channel axis Y-Y and rod axis R-R. For example, axis Y-Y and R-R of FIG. 7 may comprise a coaxial and/or parallel alignment, and inserting rod 154 into channel 6 may maintain the alignment by pressing exterior surfaces of anchor portion 3 against interior surfaces of channel 140 and/or interior surfaces of portion 3 against exterior surfaces of rod 154.

As shown in FIG. 7, the fit between entry opening 146 and end portion 152 may cause rod 154 to be offset from passage 144 by a fixed distance. Rod 154 may prevent end 2 from being pulled out of channel 140 through passage 144 by maintaining the fixed distance. For example, rod 154 may be cantilevered from end portion 152 or span between end portion 152 and another interior surface of channel 140. As shown conceptually in FIG. 7, a diameter or width of rod 154 may be greater than a corresponding width of passage 144 to further prevent end 2 from being pulled through passage 144 even if rod 154 flexes under load and/or breaks away from end portion 152 during use.

Figure 8:
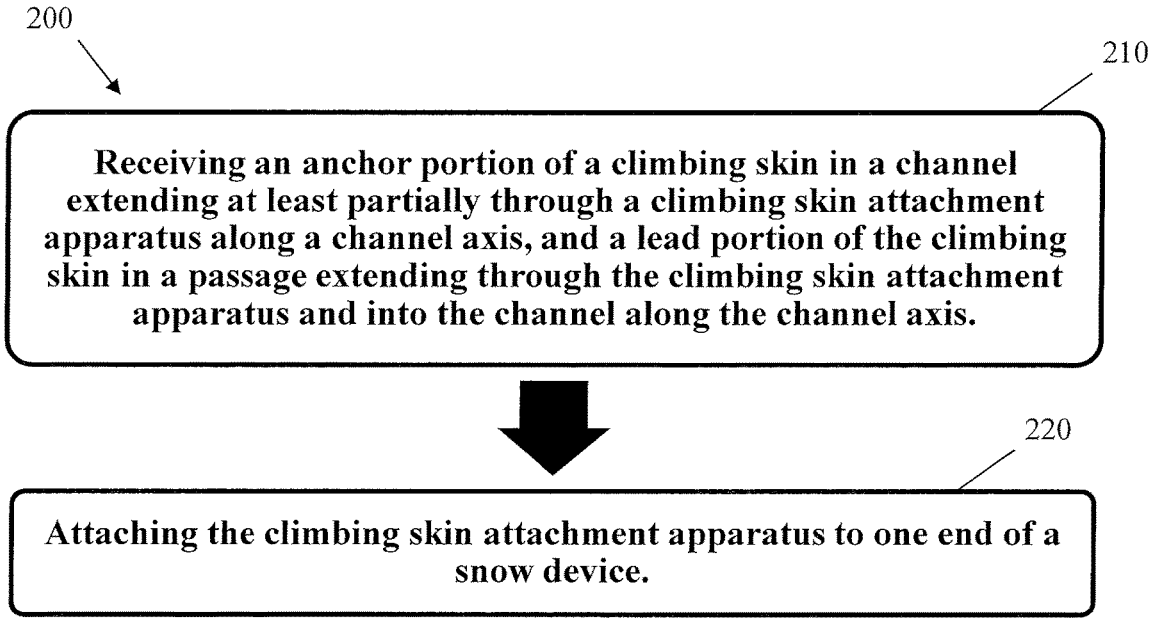
FIG. 8 depicts an exemplary climbing skin attachment method.

Additional aspects of channel 140 and/or rod 152 may be engageable with anchor portion 3 to limit movements of climbing skin 1. For example, interior surfaces of channel 140 and/or exterior surfaces of rod 152 may be engageable with corresponding exterior and/or interior surfaces of anchor portion 3. In this example, said surfaces of channel 140 and/or rod 154 may comprise at least one of a barb, a hook, a protrusion, and/or any like elements engageable with anchor portion 3 to limit movements of skin 1. An exemplary climbing skin attachment method 200 is shown in FIG. 8. For ease of description, aspects of method 200 are now described with reference to climbing skin attachment apparatus 10. As shown in FIG. 8, attachment method 200 may comprise: receiving anchor portion 3 of climbing skin 1 in channel 40 extending at least partially through climbing skin attachment apparatus 10 along channel axis Y-Y, and lead portion 5 of climbing skin 1 in passage 44 extending through climbing skin attachment apparatus 10 and into channel 40 along channel axis Y-Y (a "receiving step 210"); and attaching climbing skin attachment apparatus 10 to end 8 of snow device 7 (an "attaching step 220").

Method 200 may comprise intermediate steps for forming anchor portion 3. For example, method may comprise rolling and/or folding a length of climbing skin 1 back onto itself, and attaching the length to another length of skin 1 so as to define anchor shape 4 and/or lead portion 5. Method 200 also may comprise any intermediate steps for assembling attachment apparatus 10, such as attaching the respective first and second arms 22 and 25 of first and second snow device holders 21 and 24 to first and second pivots 23 and 26.

As shown in FIG. 3, receiving step 210 may comprise moving (e.g., sliding) anchor portion 3 into channel 40 along channel axis Y-Y. For example, step 210 may comprise aligning anchor portion 3 with channel 40, aligning lead portion 5 with passage 44, and sliding anchor portion 3 together with lead portion 5 along axis Y-Y into channel 40 and passage 44 so that the remainder of skin 1 extends outwardly from an opening 45 of passage 44 (e.g., FIG. 4) along longitudinal axis X-X. Step 210 may comprise additional alignment steps. For example, step 210 also may comprise moving apparatus 10 relative to climbing skin 1 to align the longitudinal axis of skin 1 with longitudinal axis X-X, and wedging anchor shape 4 into passage 44 to maintain the alignment. Attaching step 220 may be configured according to any configuration of snow device connection portion 20. For apparatus 10 of FIG. 2, for example, step 240 may comprise: engaging first snow device holder 21 with a first edge of snow device 7 and engaging second snow device holder 24 with a second edge of device 7. In keeping with above, step 210 may further comprise rotating holder 21 and/or 24 relative to snow device 7, and/or making similar adjustments relative to a particular configuration of connection portion 20.

Figure 8A:
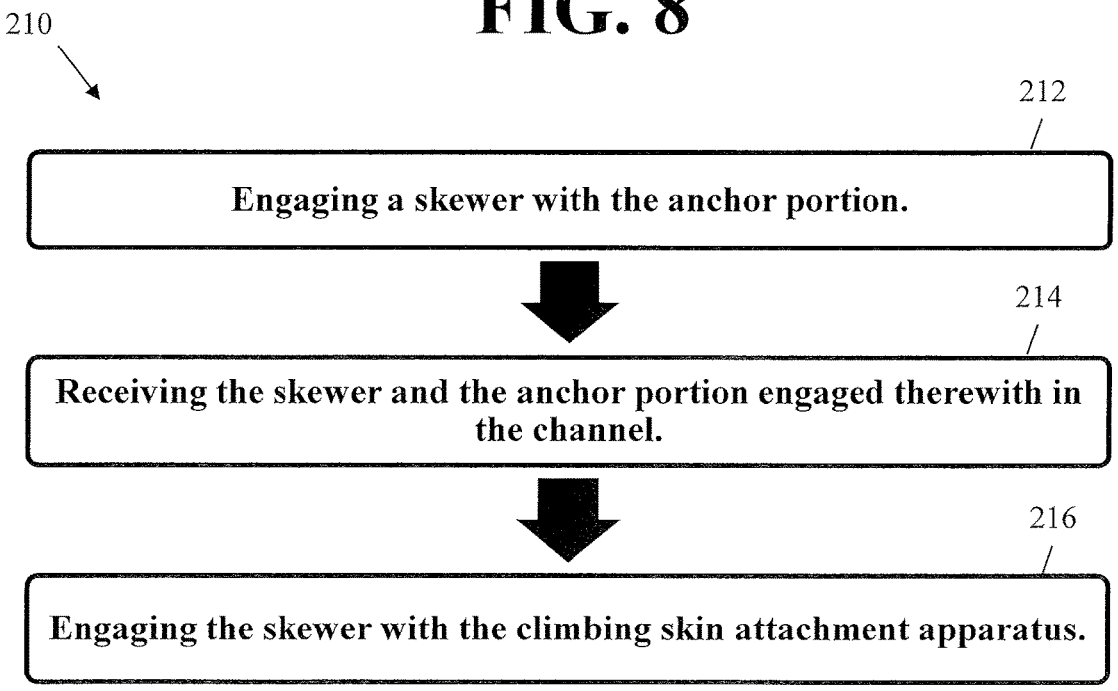
FIG. 8A depicts additional exemplary steps of the method of FIG. 8.

As shown in FIG. 8A, aspects of method 200 may be modified for use with climbing skin attachment apparatus 110. For example, receiving step 210 may comprise: engaging skewer 150 with anchor portion 3 (an "engaging step 212"); receiving skewer 150 and anchor portion 3 engaged therewith in channel 140 (a "receiving step 214"); and engaging skewer 150 with apparatus 110 (an "engaging step 216").

Figure 10:
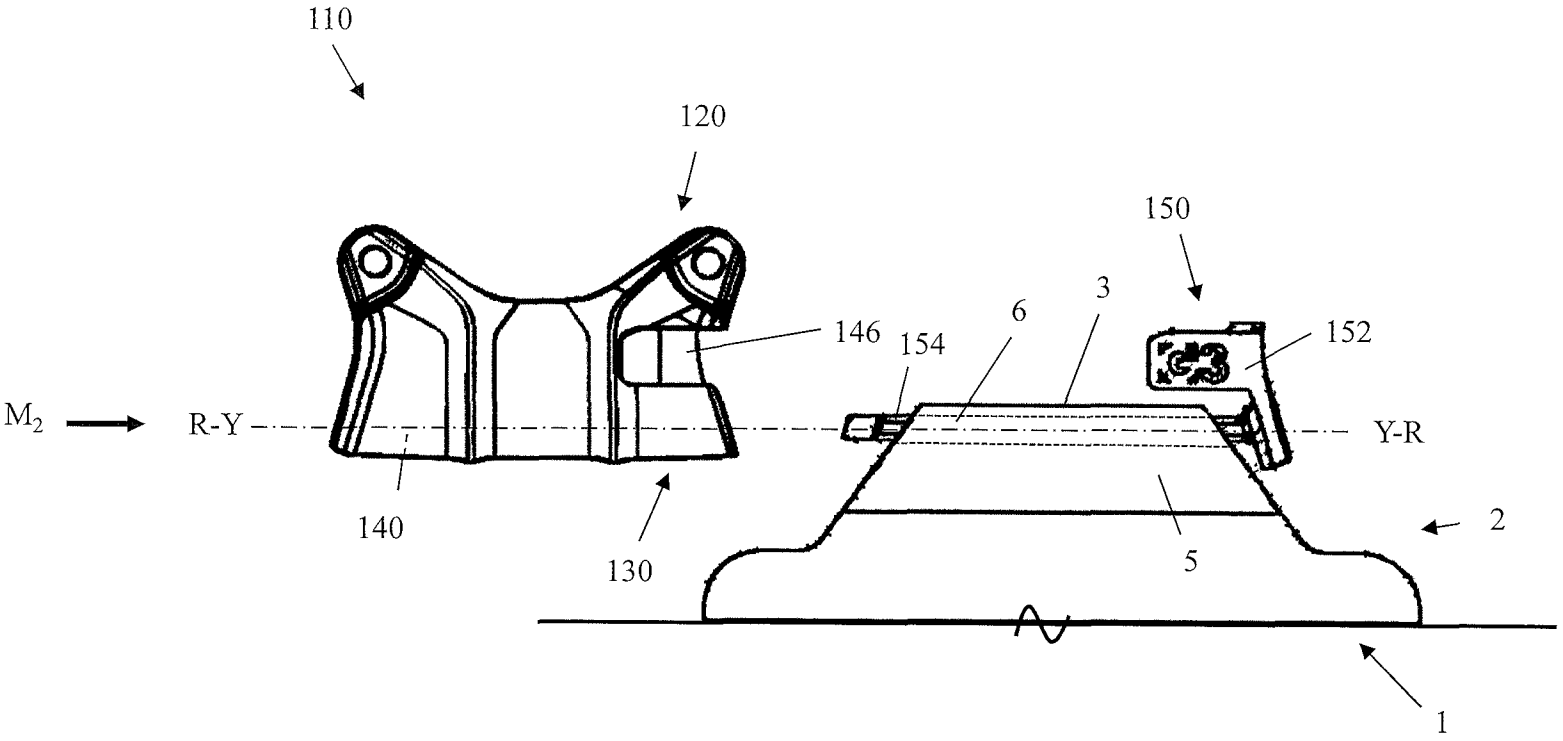
FIG. 10 depicts an exemplary second operational view of the apparatus of FIG. 5.

As shown in FIG. 9, engaging step 212 may comprise inserting rod 154 of skewer 150 into anchor channel 6 of anchor shape 4 by holding climbing skin 1 steady, and moving skewer 150 along rod axis R-R in first movement direction $M_1$ toward channel 6. As shown in FIG. 10, receiving step 214 may comprise inserting rod 154 and shape 4 into channel 140. In this example, the additional mass and rigidity provided by skewer 150 may help to slide anchor portion 3 and lead portion 5 into channel 140 along channel axis Y-Y without bunching up. Accordingly, engaging step 216 may comprise holding skewer 150 steady, and moving apparatus 110 along channel axis Y-Y in a second movement direction $M_2$ towards skewer 150. As shown in FIG. 10, engaging step 216 also may comprise engaging end portion 152 of skewer 150 with attachment portion 130, such as with entry opening 146. For example, step 216 may comprise moving attachment apparatus 110 along channel axis Y-Y until end portion 152 is snapped into opening 146.

As described herein, climbing skin attachment apparatus 10 and 110 may be configured to removably attach end 2 of climbing skin 1 to end 8 of snow device 7, and limit movements of climbing skin 1 relative to snow device 7. End 8 is depicted in FIG. 1 as a front end of climbing skin 1. It is contemplated that apparatus 10 and/or 110 may be similarly configured to removably attach a rear end of climbing skin 1 to a rear end of snow device 7, allowing either the front end or the rear end of skin 1 to be used interchangeably with any type of climbing skin attachment apparatus 10 or 110. To demonstrate, aspects of an exemplary climbing skin attachment system 300 are now described with reference to FIGS. 11-16.

Figure 11:
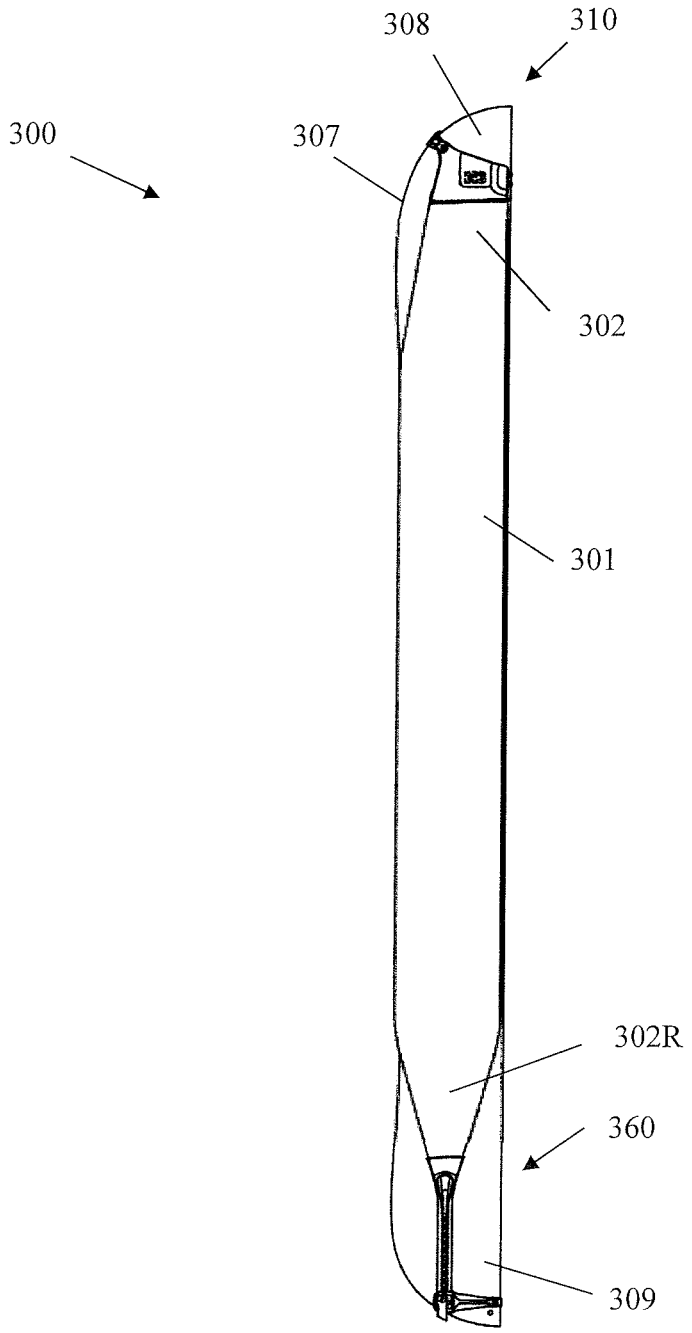
FIG. 11 depicts an exemplary climbing attachment system comprising an exemplary first climbing skin attachment apparatus attached to a front end of an exemplary snow device and an exemplary second climbing skin attachment apparatus attached to a rear end of the exemplary snow device.

As shown in FIG. 11, attachment system 300 may comprise a climbing skin 301; a front climbing skin attachment apparatus 310 removably engageable with a front end 302 of skin 301; and a rear climbing skin attachment apparatus 360 removably engageable with a rear end 302R of skin 301. For example, a different snow device 307 is shown in FIG. 11 as one half of a split snowboard comprising a front end 308 engaged with front apparatus 310 and a rear end 309 engaged with rear apparatus 360. Front attachment apparatus 310 may comprise a snow device connection portion 320 that is different from a snow device connection portion 370 of rear attachment apparatus 360. To promote interchangeability, attachment apparatus 310 may have a climbing skin attachment portion 330 that is similar to a climbing skin attachment portion 380 of apparatus 360. For example, both attachment portions 330 and 380 may be similar to attachment portion 30 of FIG. 3.

Figure 12:
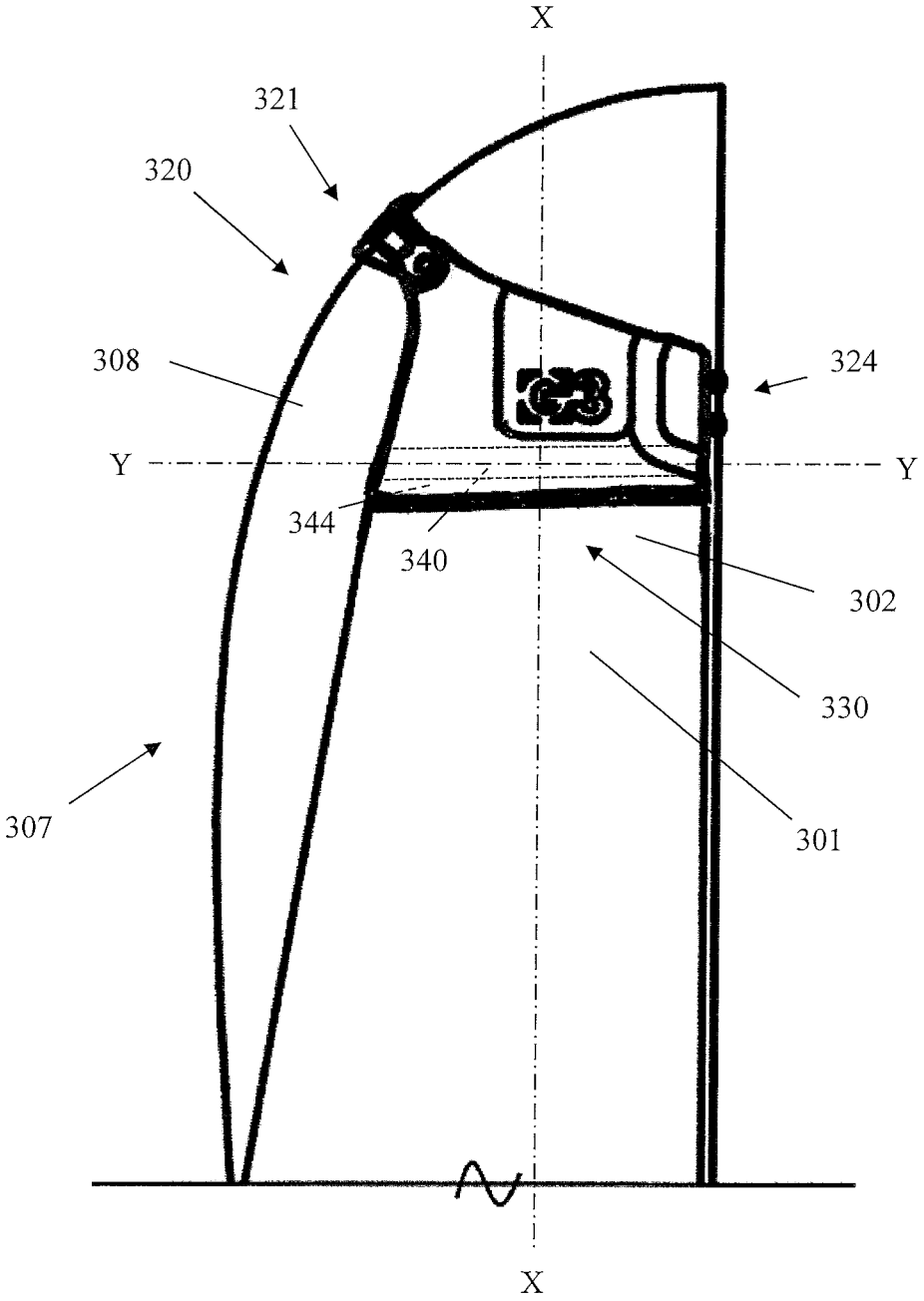
FIG. 12 depicts a close-up snow facing view of the first apparatus of FIG. 11.

As shown in FIG. 12, connection portion 320 of apparatus 310 may be disposed opposite of or coaxial with attachment portion 330. Similar to above, a channel 340 and a passage 344 extending into channel 340 may extend at least partially through attachment portion 330 along a channel or lateral axis Y-Y, which may be non-parallel with a longitudinal axis X-X of apparatus 310. For example, channel 340 and passage 344 (both shown conceptually with dotted lines in FIG. 12) may comprise cross-sections similar to that of channel 40 and passage 44 of FIG. 3 so that an anchor portion of climbing skin 301 at front end 302 (e.g., similar to anchor portion 3) may be similarly received along channel axis Y-Y.

As before, connection portion 320 may comprise any closed and/or open shape(s) engageable with front end 308 of snow device 307. For example, connection portion 320 of FIG. 12 may comprise a first snow device holder 321 engageable with a curved edge of front end 308 and a second snow device holder 324 engageable with a straight edge of end 308.

Figure 13:
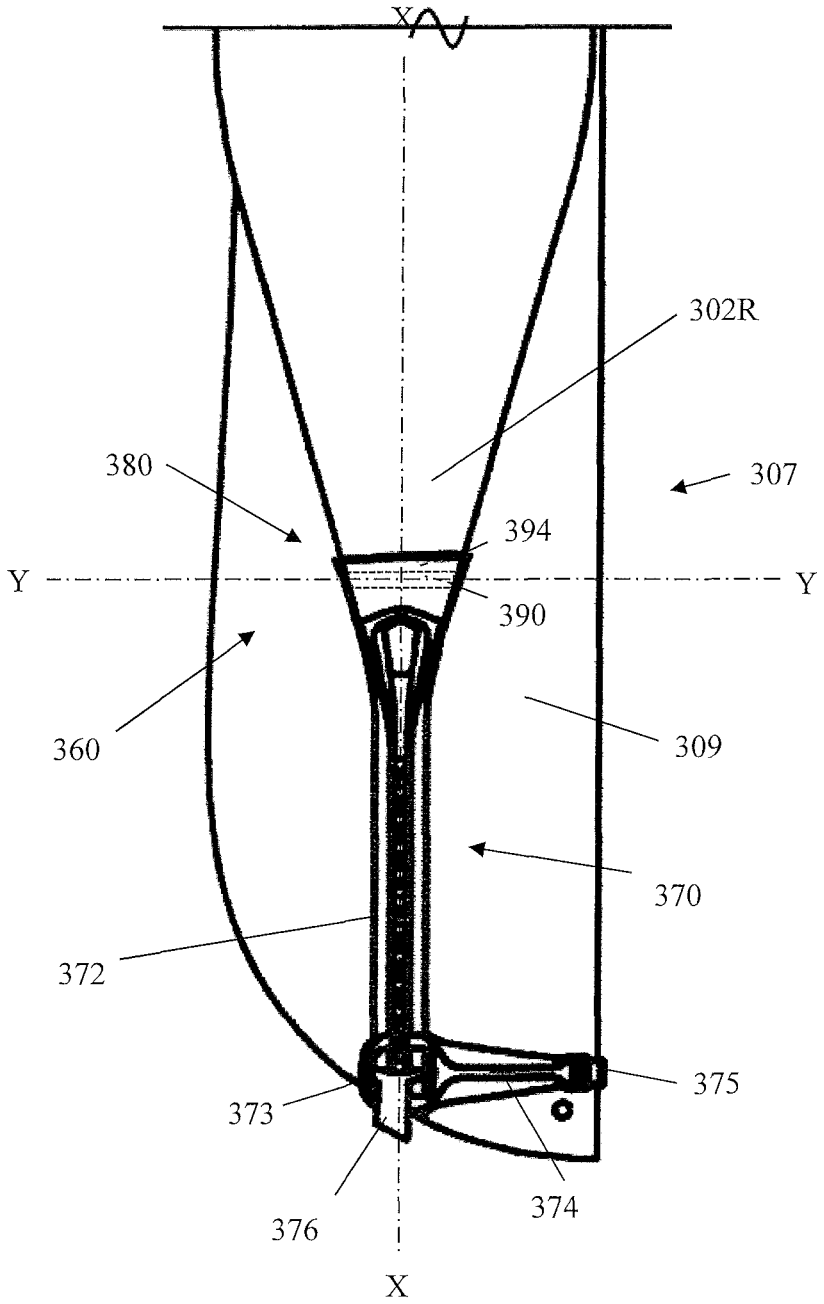
FIG. 13 depicts a close-up snow facing view of the second apparatus of FIG. 11.

As shown in FIG. 13, connection portion 370 of apparatus 360 also may be disposed opposite of or coaxial with attachment portion 380. As before, a channel 390 and a passage 394 extending into channel 340 may extend at least partially through attachment portion 380 along a channel or lateral axis Y-Y, which may be non-parallel with a longitudinal axis X-X of apparatus 360. For example, channel 390 and passage 394 may likewise comprise cross-sections similar to that of channel 40 and passage 44 of FIG. 3 so that another anchor portion of climbing skin 301 at rear end 302R of FIG. 13 (e.g., also similar to anchor portion 3) may be similarly received along channel axis Y-Y.

Figure 14:
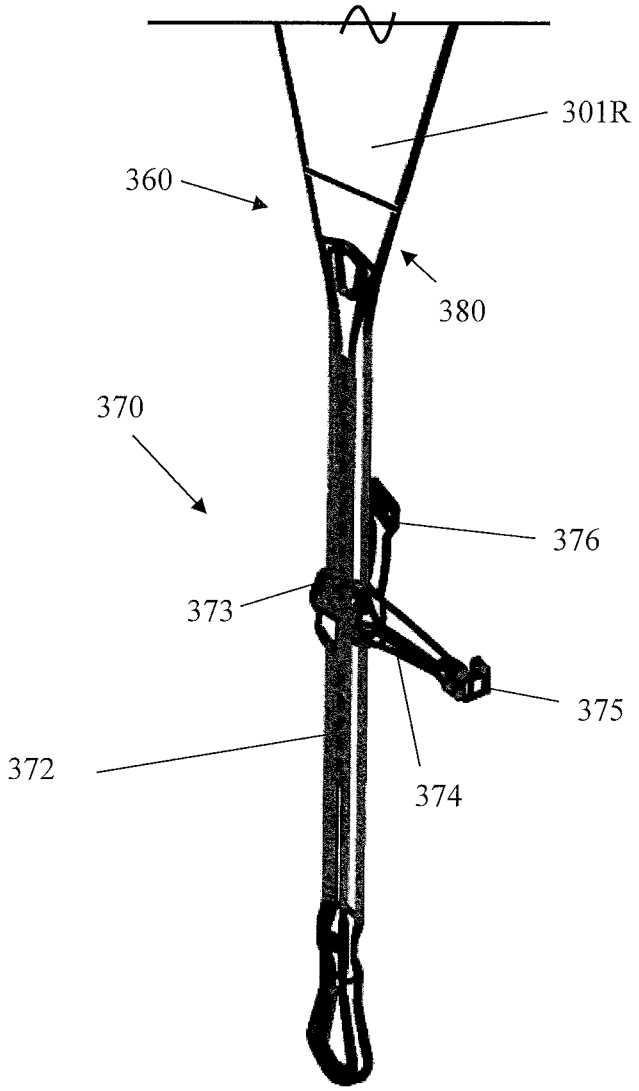
FIG. 14 depicts an exemplary first operational view of the second apparatus of FIG. 11 removed from the snow device.

Connection portion 370 may comprise any open and/or closed shape(s) engageable with rear end 309 of snow device 307. As also shown in FIGS. 13 and 14, for example, snow device connection portion 370 of FIG. 12 also may comprise a rear clip apparatus. For example, connection portion 370 may comprise: a tensioning strap 372; a first arm 374; and a second arm 376 pivotally attached to first arm 374. Tensioning strap 372 may extend outwardly from apparatus 310, through a pivot 373 of first arm 374, and back toward apparatus 310 for attachment thereto. Tension strap 372 may be operable to apply a tensile force to climbing skin 1, and maintain that force during use. For example, tension strap 372 may be operable between an open position that permits attachment of connection portion 760 to rear end 309, as shown in FIG. 14; and a closed position that maintains the tensile force, as shown in FIG. 13, in which strap is attached to itself and/or connection portion 370.

Figure 15:
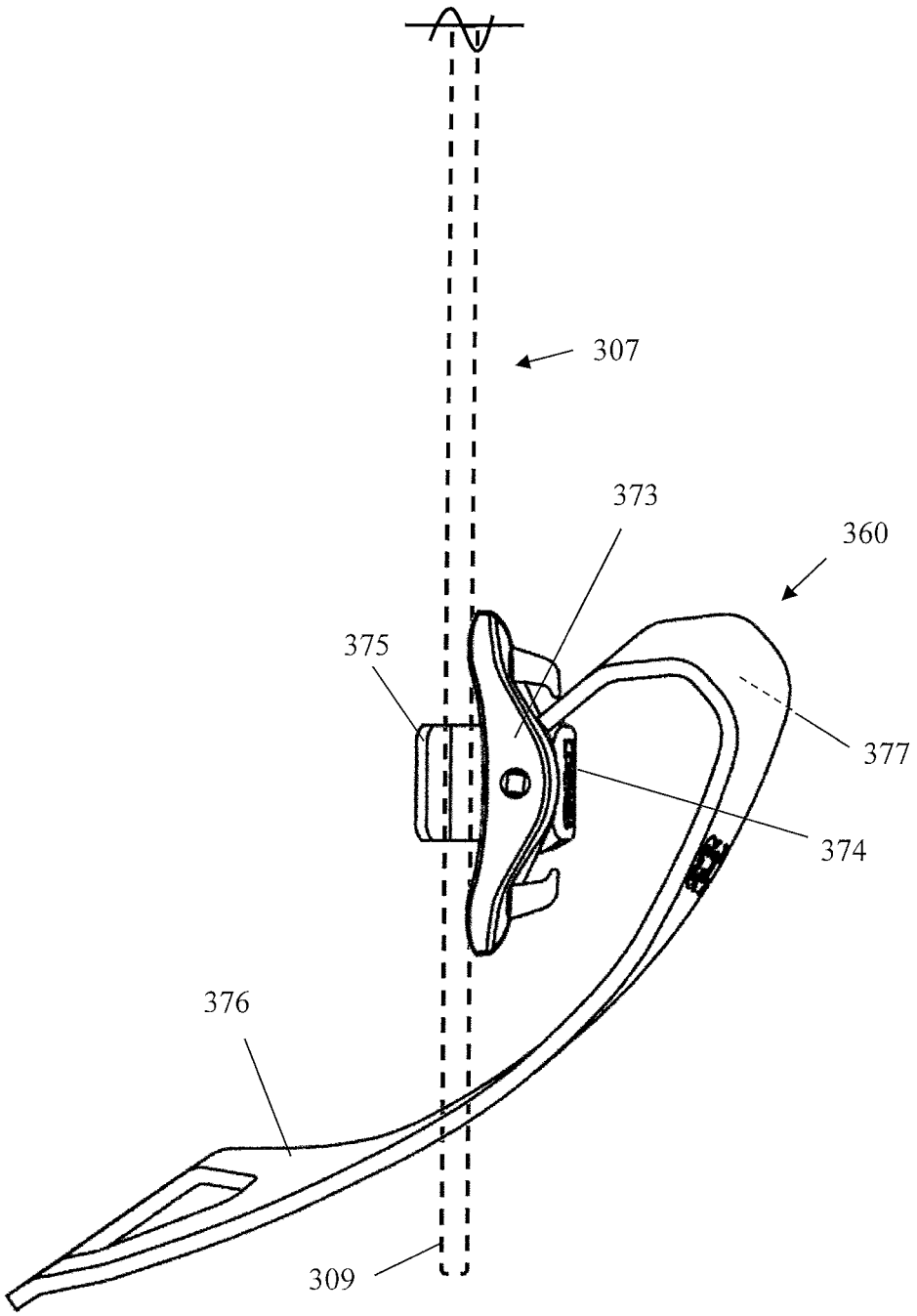
FIG. 15 depicts an exemplary second operational view of the second apparatus of FIG. 11 during attachment to the second end of the snow device.
Figure 16:
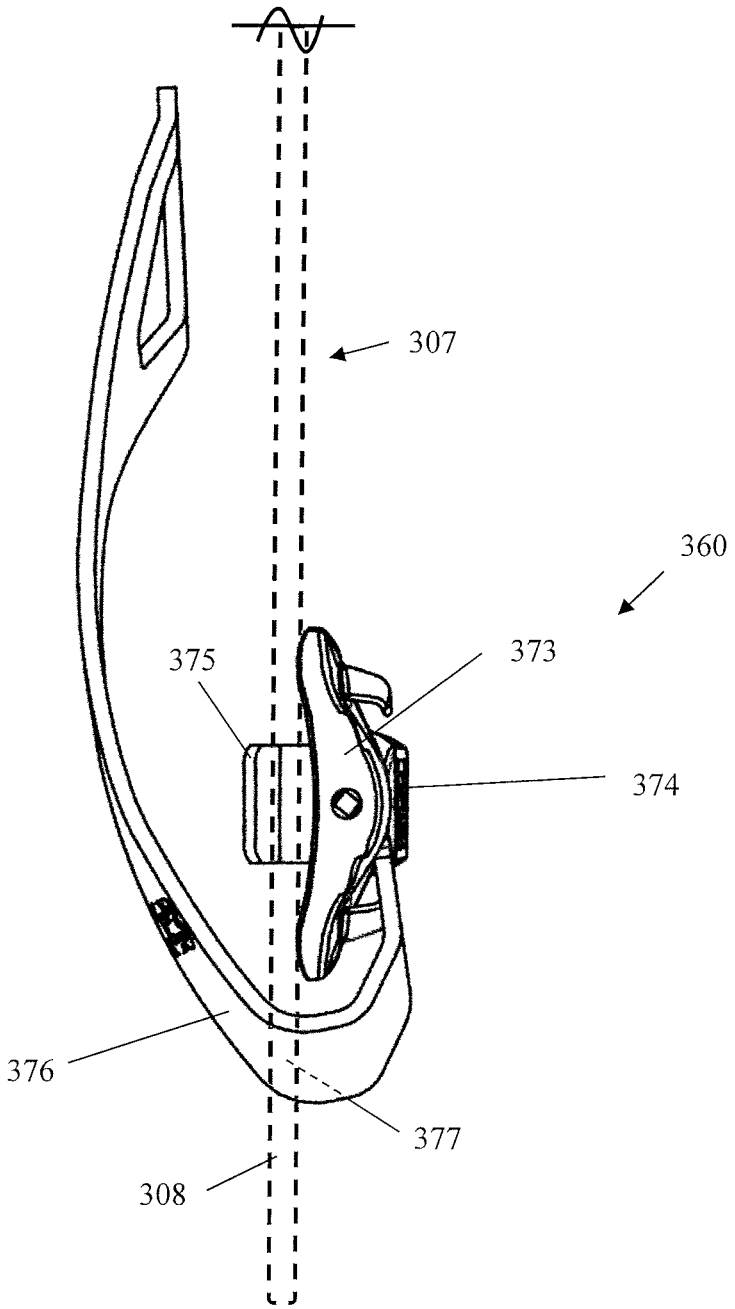
FIG. 16 depicts an exemplary third operational view of the second apparatus of FIG. 11 during attachment to the second end of the snow device.

As shown in FIG. 13, first arm 374 may extend between pivot 373 and a snow device holder 375. For example, first arm 374 may comprise a rigid body configured to maintain an alignment of snow device holder 375 with strap 372; and holder 375 may comprise a fixed clip engageable with a straight edge of rear end 309. As shown in FIGS. 15 and 16, second arm 376 may curve outwardly and around rear end 309 to locate a cam surface 377 adjacent a curved edge of end 309. For example, holder 375 may be attached to the straight edge of end 309 so that a back surface of first arm 374 may be placed against snow device 7, allowing second arm 375 to be pivot from an open position, in which cam surface 377 is not engaged with the straight edge, as in FIG. 15; to a closed position, in which surface 377 is engaged with the straight edge, as in FIG. 16.

Although not shown in FIGS. 11-16, it is completed that aspects of climbing skin attachment system 300 may be modified for use with any aspects of climbing skin apparatus 10 and/or 110 described herein. For example, one or both of attachment portions 330 and 380 may likewise comprise a skewer similar to skewer 150 and/or any other variations of attachment portions 30 and 130 described herein.

Numerous means for removably attaching climbing skin 1 to snow device 7 and/or limiting movements of skin 1 relative to device 7 have been described, each combination and/or iteration being part of this disclosure. For example, some aspects may be used to removably attach either end of climbing skin 1 to snow device 7 without specialized tools, and allow climbing skin 1 to be interchangeably used with different types of snow devices 7.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

What is claimed:

1. A climbing skin attachment apparatus comprising:
a climbing skin attachment portion and a snow device connection portion; and
a channel extending at least partially through the climbing skin attachment portion along a channel axis to receive an anchor portion of a climbing skin; and
a passage extending through the climbing skin attachment portion and into the channel along the channel axis to receive a lead portion of the climbing skin.

2. The apparatus of claim 1, wherein:
the climbing skin attachment portion is disposed opposite of the snow device connection portion along a longitudinal axis; and
the channel axis is non-parallel with the longitudinal axis.

3. The apparatus of claim 1, wherein the passage is configured to obtain an interference fit with the anchor portion.

4. The apparatus of claim 1, wherein the snow device connection portion comprises at least one of an open shape and a closed shape engageable with the end of the snow device.

5. The apparatus of claim 1, wherein the passage extends into the channel along a passage axis that is non-parallel with the channel axis.

6. The apparatus of claim 1, wherein:
the passage is engageable with the anchor portion to resist a longitudinal movement of the skin; and
the climbing skin attachment portion comprises at least one of a metallic material and a polymeric material configured to resist deformation of the passage during the longitudinal movement.

7. The apparatus of claim 1, wherein:
the channel extends along the channel axis between a first sidewall of the climbing skin attachment portion and second sidewall of the climbing skin attachment portion; and
at least one of the first sidewall and the second sidewall comprise a flexural reinforcing element.

8. The apparatus of claim 7, wherein the flexural reinforcing element comprises at least one of:
an end wall attached to the first and second sidewalls; and
a ribbing element of the first and second sidewalls.

9. The apparatus of claim 1, wherein an interior surface of the channel is configured to grip the climbing skin.

10. The apparatus of claim 9, wherein the interior surface of the channel comprises at least one of a barb, a hook, and a protrusion.

11. The apparatus of claim 1, comprising a skewer engageable with the anchor portion in the channel to prevent the anchor portion from being pulled through the passage.

12. The apparatus of claim 11, wherein an exterior surface of the skewer is configured to grip the climbing skin.

13. The apparatus of claim 12, wherein the exterior surface of the skewer comprises at least one of a barb, a hook, and a protrusion.

14. A climbing skin attachment method comprising:

receiving an anchor portion of a climbing skin in a channel extending at least partially through a climbing skin attachment apparatus along a channel axis, and a lead portion of the climbing skin in a passage extending through the climbing skin attachment apparatus and into the channel along the channel axis; and engaging the climbing skin attachment apparatus with a snow device.

15. The method of claim 14, comprising engaging a skewer with the anchor portion in the channel to prevent the anchor portion from being pulled through the passage.

16. The method of claim 15, comprising securing the skewer to the climbing skin attachment apparatus.

17. A climbing skin attachment system comprising:

(A) one or more climbing skin attachment apparatus comprising:

a climbing skin attachment portion and a snow device connection portion along a longitudinal axis;

a channel extending at least partially through the climbing skin attachment portion along a channel axis; and a passage extending through the climbing skin attachment portion and into the channel along the channel axis; and (B) a climbing skin comprising:

at least one anchor portion receivable in the channel of at least one of the one or more climbing skin attachment apparatus along the channel axis; and at least one lead portion receivable in the passage of the at least one climbing skin apparatus along the channel axis.

18. The system of claim 17, wherein:

the climbing skin comprises a first end comprising a first anchor portion and a first lead portion and a second end comprising a second anchor portion and a second lead portion; and the one or more climbing skin attachment apparatus comprise:

a first apparatus comprising a first channel and a first passage configured to receive the corresponding first anchor portion and first lead portion of the first end of the climbing skin; and a second apparatus comprising a second channel and a first passage configured to receive the corresponding second anchor portion and second lead portion of the second end of the climbing skin.

19. The system of claim 17, wherein the one or more climbing skin attachment apparatus comprise a rear clip apparatus comprising:

a tension strap extending between the climbing skin attachment portion and the snow device connection portion;

a first arm extending along an arm axis between a fixed clip and a strap opening engageable with the tension strap; and a second arm comprising:

a pivot engageable with the first arm; and a cam surface engageable with an edge of a snow device when the second arm is pivoted about the first arm with the pivot.

20. The system of claim 19, wherein the fixed clip is engageable with a straight edge of the snow device, and the cam surface is engageable with a curved edge of the snow device along a camming axis that intersects the arm axis.

* * * * *